US008708436B2

(12) United States Patent
Laible

(10) Patent No.: US 8,708,436 B2
(45) Date of Patent: Apr. 29, 2014

(54) ARRANGEMENT OF TELESCOPIC EXTENSIONS

(75) Inventor: Karl-Friedrich Laible, Langenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1775 days.

(21) Appl. No.: 11/919,719

(22) PCT Filed: Mar. 30, 2006

(86) PCT No.: PCT/EP2006/061167

§ 371 (c)(1),
(2), (4) Date: Oct. 30, 2007

(87) PCT Pub. No.: WO2006/120074

PCT Pub. Date: Nov. 16, 2006

(65) Prior Publication Data

US 2009/0026903 A1 Jan. 29, 2009

(30) Foreign Application Priority Data

May 10, 2005 (DE) ..... 10 2005 021 593

(51) Int. Cl.
*A47B 88/00* (2006.01)

(52) U.S. Cl.
USPC ..... 312/334.7; 312/334.1; 312/330.1; 312/348.1

(58) Field of Classification Search
USPC ..... 312/330.1, 402, 404, 333, 348.4, 348.1, 312/348.2, 334.1, 334.6, 334.7, 334.29, 312/334.35; 384/19–22
See application file for complete search history.

(56) References Cited

U.S. PATENT DOCUMENTS

| | | | | |
|---|---|---|---|---|
| 4,423,914 | A * | 1/1984 | Vander Ley | 312/333 |
| 4,838,627 | A * | 6/1989 | Macias | 312/334.8 |
| 5,211,461 | A * | 5/1993 | Teufel et al. | 312/334.4 |
| 5,632,542 | A * | 5/1997 | Krivec | 312/334.7 |
| 5,890,784 | A * | 4/1999 | Domig | 312/334.4 |
| 6,076,908 | A * | 6/2000 | Maffeo | 312/334.7 |
| 6,199,967 | B1 * | 3/2001 | Bayles et al. | 312/334.7 |
| 6,209,979 | B1 * | 4/2001 | Fall et al. | 312/330.1 |
| 6,231,141 | B1 * | 5/2001 | Liebertz et al. | 312/263 |
| 6,447,083 | B1 | 9/2002 | Chiapetta et al. | |
| 6,601,933 | B1 * | 8/2003 | Greenwald | 312/333 |

FOREIGN PATENT DOCUMENTS

EP 0 185 201 6/1986

OTHER PUBLICATIONS

International Search Report PCT/EP2006/061167.

* cited by examiner

*Primary Examiner* — Darnell Jayne
*Assistant Examiner* — Timothy M Ayres
(74) *Attorney, Agent, or Firm* — James E. Howard; Andre Pallapies

(57) ABSTRACT

The invention relates to two telescopic extensions that can be deployed in a refrigerating device to support thereon a goods carrier, such as a door-type goods carrier for refrigerated goods. Bridges are mounted on movable rails of the telescopic extensions and delimit, together with the movable rail, a gap for receiving a first carrier tab element of the goods carrier. The width of the gap is larger than the thickness of the first carrier tab element, and a first stabilizer tab element is inserted into the free space remaining after the first carrier tab element is inserted into the gap.

8 Claims, 4 Drawing Sheets

Fig. 6
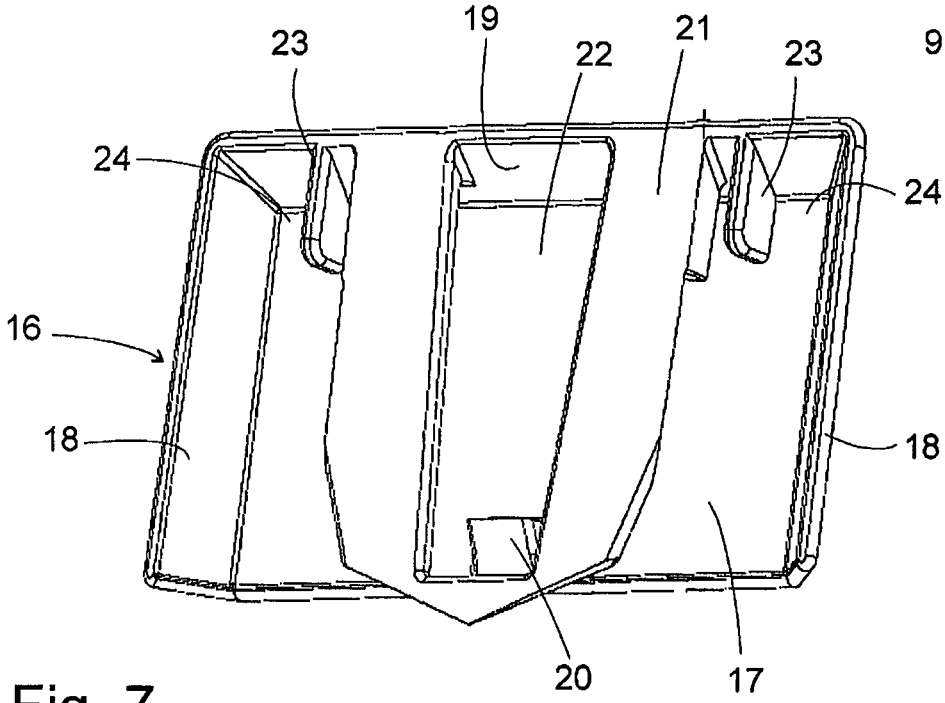
Fig. 7
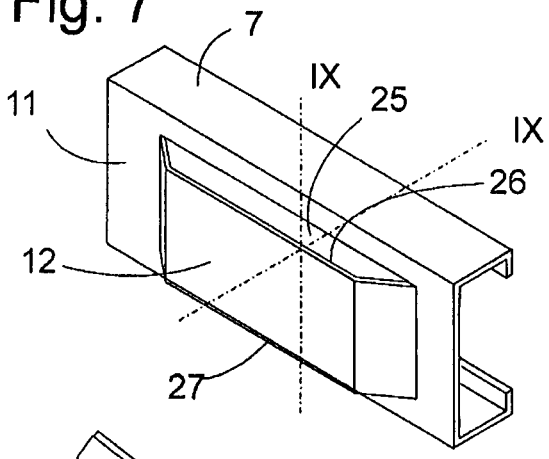
Fig. 9
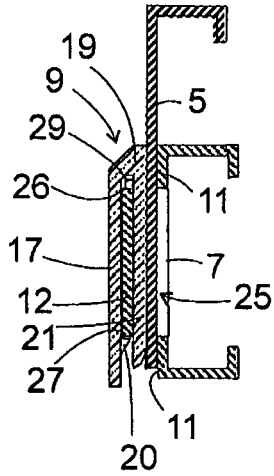
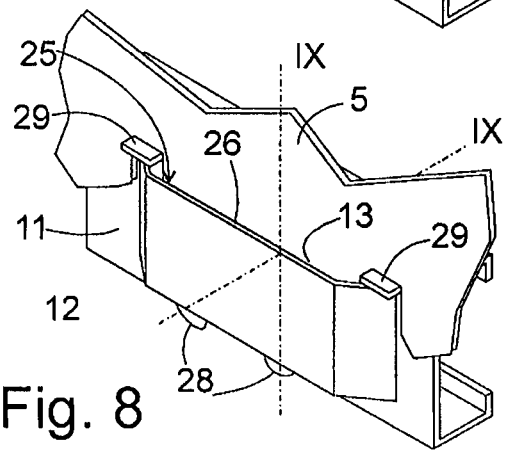
Fig. 8

ARRANGEMENT OF TELESCOPIC EXTENSIONS

The present invention relates to an arrangement of telescopic extensions of the type used, for example, in refrigerating devices, comprising two telescopic extensions and a moving part carried by the telescopic extensions, where it can be, for example, a carrier for refrigerated goods such as a shelf or a drawer, or a slide-out door of a refrigerator section—possibly combined with a container for refrigerated goods.

The telescopic extensions of such an arrangement generally each comprise at least two rails that can be moved against each other, whereby the carried part is attached to one of the rails and the other rail is fixed, usually mounted on an inside wall of the housing of the refrigerating device.

In order to connect the carried part with the movable rails, it is known to form bridges on the sides of the movable rails, which delimit a slot between themselves and the side of the rail, from which they are formed, in which slot a tongue of the carried part can be inserted.

The tongue must sit halfway in the slots in a firm fashion in order to prevent the carried part becoming accidentally detached from the rails. Normally, therefore, the slot is made so narrow that the tongue engages frictionally into said slot. This, however, makes the insertion of the tongues into the slots difficult, especially if the carried part is heavy and unwieldy.

The object of the invention is to create a telescopic arrangement of the type described above, wherein the insertion of the tongue of the carried part into the bridges of the telescopic extensions is made easier, and wherein, nevertheless, the danger of the carried part becoming accidentally detached from the telescopic extensions is negligible.

The object is achieved by the width of the gap being greater than the thickness of the first tongue, so that said tongue can be inserted into the gap with play, and by a second tongue being inserted into the free space remaining after the first tongue has been inserted into the gap. As this tongue no longer necessarily has to be a component of the carried part, it can be a small, light additional part that is easy to manage.

The second tongue is preferably held frictionally engaged in the gap so it is secure.

According to a preferred embodiment, the second tongue is part of a push-on cover, which also includes a shell, which covers the bridge to give the arrangement of telescopic extensions an attractive appearance.

In the case of this embodiment, a catch, engaged on the bridge, can also be formed on the push-on cover, especially on its shell, to secure the second tongue in the gap.

Advantageously the push-on cover should be resilient and pliant, so that it is possible to detach the catch from the bridge and, if necessary, thus remove the second tongue.

In order to prevent the carried part from accidentally becoming detached from the telescopic extensions, also by positive locking, the carried part has preferably at least one projection engaging in the interior of the shell of the push-on cover.

Two such projections on either side of the first tongue are advantageous, as they essentially only transfer a tensile force, and no torque to the push-on cover, so that there is less danger of the push-on cover being damaged in the event of improper handling.

Further features and advantages of the invention become clear using the following description of exemplary embodiments and making reference to the attached figures, in which.

Figure 3:
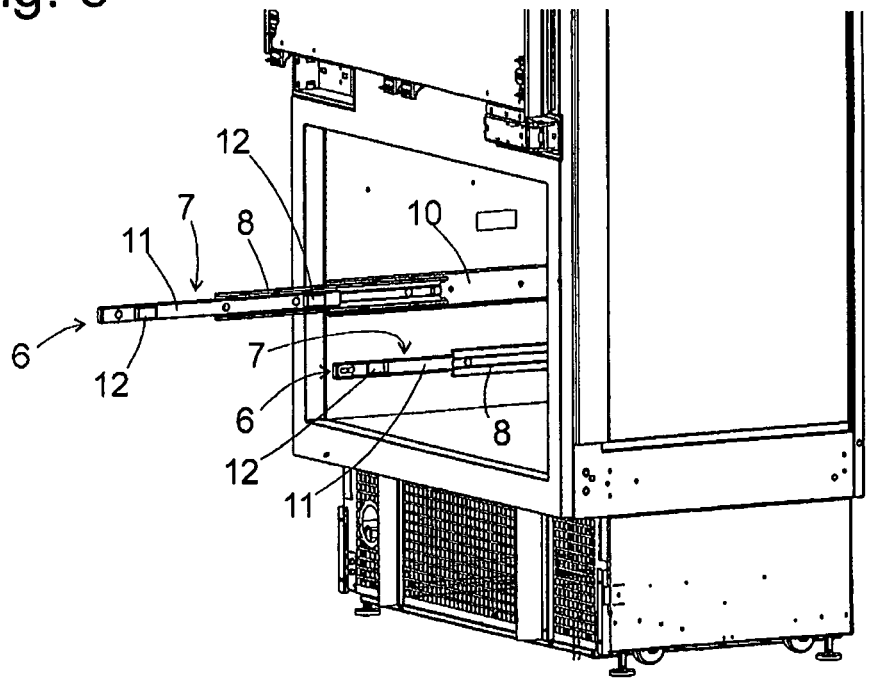
Figure 4:
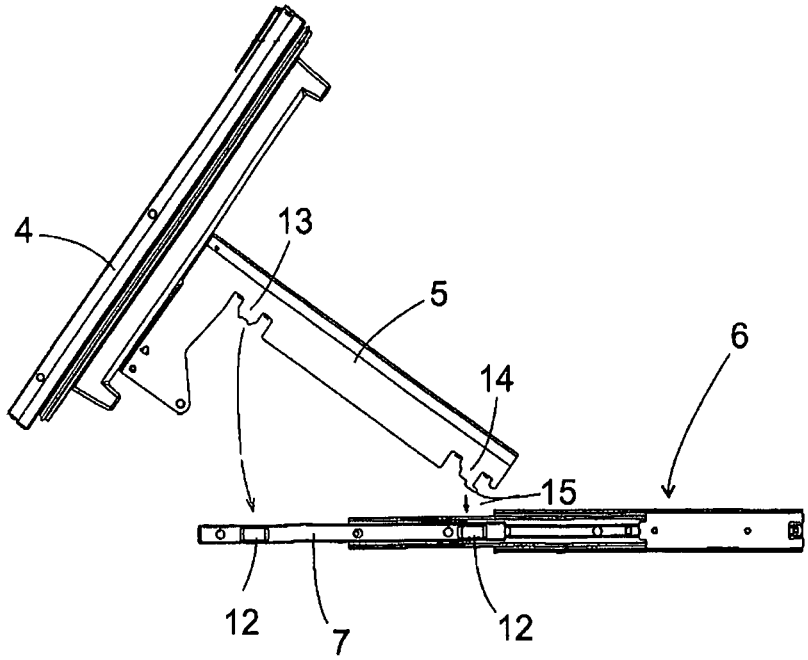
Figure 5:
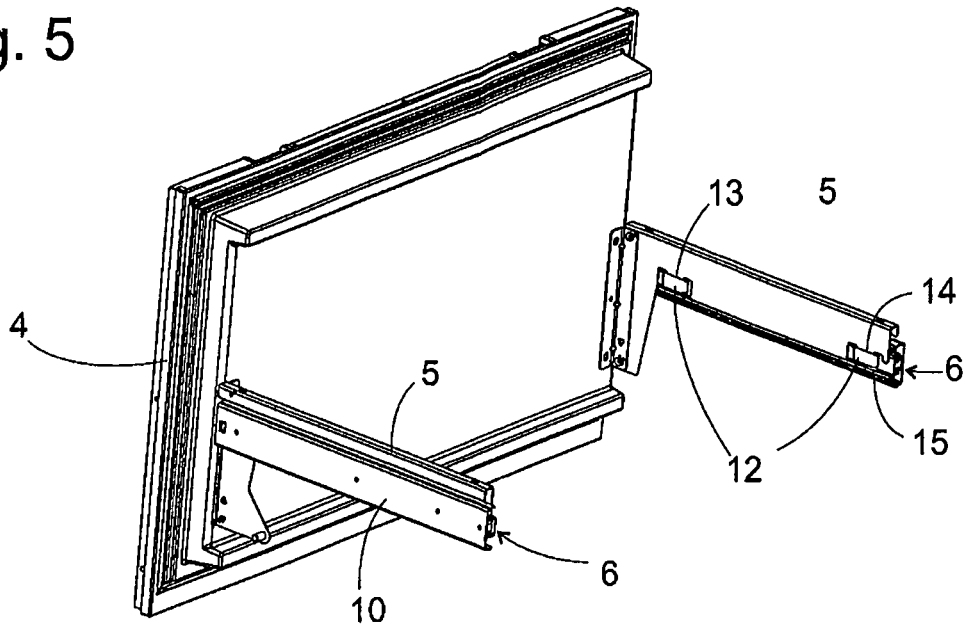

FIG. 3 likewise shows the bottom part of the refrigerating device, but with the slide-out door left out;

FIG. 4 a slide-out door being mounted on a telescopic extension;

FIG. 5 shows a perspective view of an arrangement of telescopic extensions according to the invention comprising the slide-out door and two telescopic extensions;

FIG. 6 shows a view of a push-on cover of the arrangement according to the invention;

FIG. 7 shows a section of a rail of a telescopic extension with a bridge formed in it;

FIG. 8 shows the same rail section as in FIG. 7, wherein a tongue of a bracket is inserted into a slot delimited by the bridge; and FIG. 9 shows a cross-section of the rail and of the bracket, which is secured in the slot with the aid of the push-on cover from FIG. 6.

Figure 1:
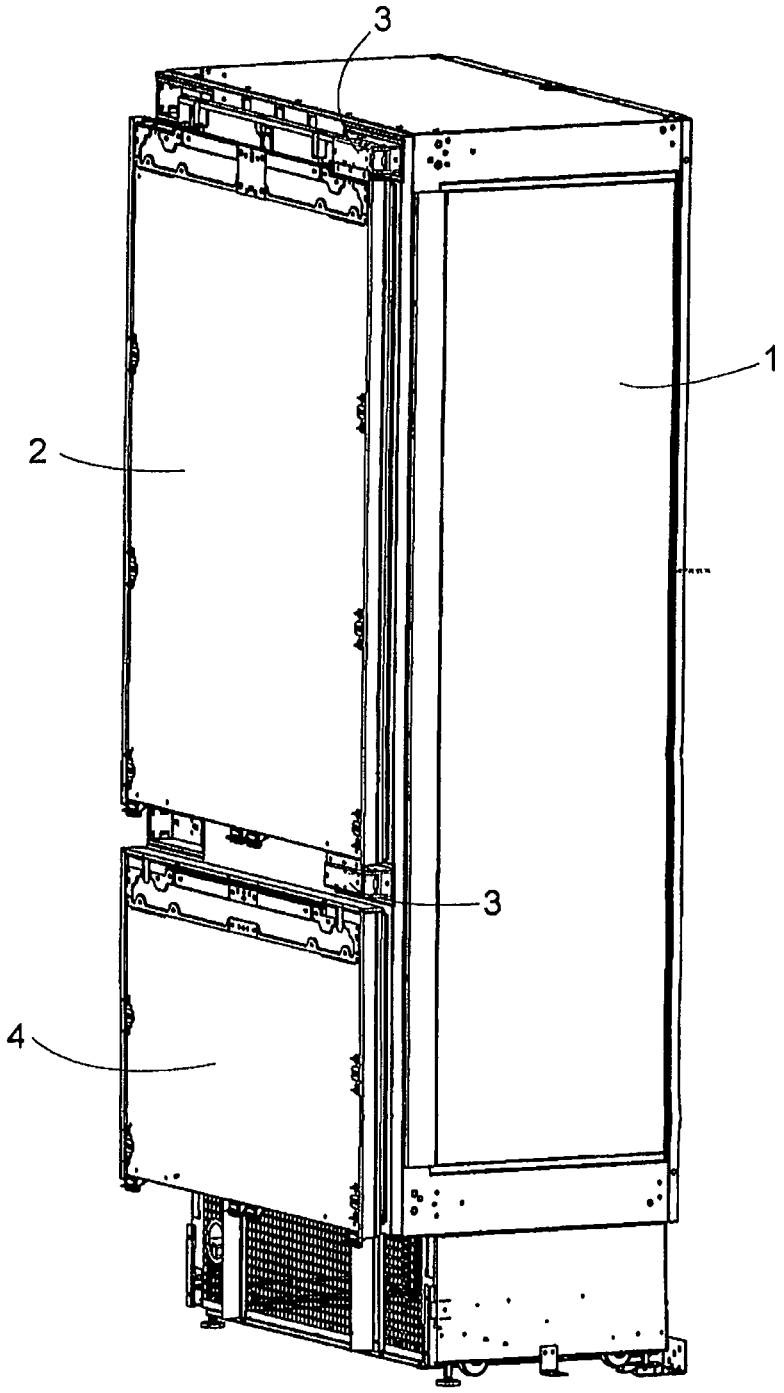
FIG. 1 shows a perspective view of a refrigerating device, where the inventive arrangement of telescopic extensions is used.

FIG. 1 is a perspective view of a fitted refrigerating device 1 without casing, which will be used to explain this invention. The refrigerating device 1 has two goods carriers shown as refrigerator compartments kept at different temperatures, an upper compartment, which is closed by means of a swing door 2 hung on multi-link hinges 3, and a lower compartment, which is closed by means of a parallel slide-out door 4 that can be pulled out.

Figure 2:
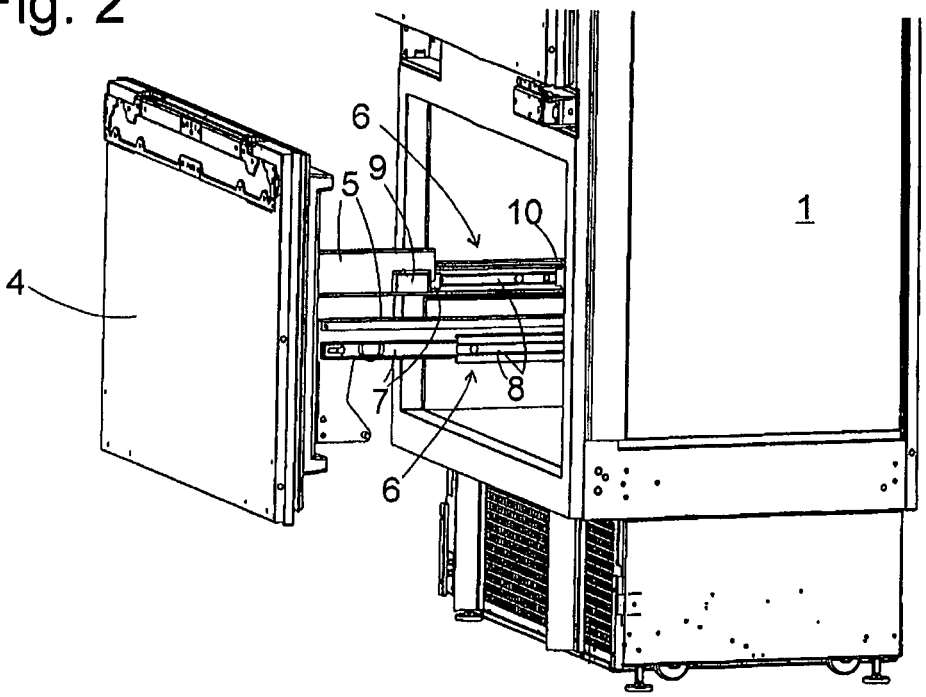
FIG. 2 shows a perspective view of the bottom part of the refrigerating device in FIG. 1 with the slide-out door pulled out.

FIG. 2 shows a view of the bottom part of the refrigerating device 1 with the slide-out door 4 pulled out. Two brackets 5 protruding to the rear are fastened vertically to the slide-out door 4, which brackets for their part are held on movable rails 7 by two telescopic extensions 6, the fixed rails of which are attached to side walls of an inner container of the lower refrigerator section. Two joints, at which the weight of the brackets 5 and of the slide-out door 4 is transmitted into each movable rail 7, are each concealed under positioned covers 9 made of plastic, of which only one is visible in FIG. 2.

FIG. 3 thus shows first a perspective view in line with FIG. 2, in which view the slide-out door 4 and its brackets 5 are left out. Here one can see that each telescopic extension 6 comprises a total of three rails 7, 8, 10, which can each be slid against each other by about half their length. The rail 7 has a vertical side 11, from which, adjacent to its front and rear end, two bridges 12 are formed. The bridges 12 span respectively an upwards and downwards open vertical slot. A section of the rail 7 with the bridge 12 and the slot is shown in FIG. 7, which will be dealt with in greater detail later.

FIG. 4 shows a side view of a telescopic extension 6 in the fully extended state also shown in FIG. 3 and of the slide-out door 4 separated from the telescopic extension 6 with the brackets 5 attached to it. On a bottom edge of each bracket 5 two carrier elements shown as tongues 13, 14 are cut out, which are designed to engage in the slots delimited by the bridges 12. The tongue 14, backward in relation to the direction of the depth of the refrigerating device 1, has a backwards oriented projection 15, which requires the slide-out door 4 to be lowered in the slanted orientation shown in FIG. 4, in order to insert the tongue 14 into the slot of the rear bridge 12. When the projection 15 has passed through the slot of the rear bridge 12 and emerges again at its lower opening, the assembly consisting of the slide-out door 4 and brackets 5 can be swung downwards around a horizontal axis running through the two tongues 14 of its two brackets 5, so that the brackets 5 reach a horizontal position, in which their front tongues 13 engage into the slot of the front bridge 12 of the telescopic extensions 6. In this position, also shown in FIG. 5, the projection 15 engaging respectively at a lower edge of the bridges 12 prevent the weight of the slide-out door 4 or of a downwards directed outside force acting on the slide-out door 4 from causing the rear tongues 14 to be pulled out of their slots and slide-out door 4 and brackets 5 to tip around an axis running through the front tongues 13.

As the thickness of the tongues 13, 14 is distinctly smaller than the width of the slots that accommodates them, and, therefore, the tongues 13, 14 in the configuration shown in FIG. 5, are not locked in the slots, it is possible that, if a user pulls out the door 4 and in so doing exerts an upwards directed force on the door 4, he thus lifts the front tongues 13 up out of their slots, which can result in the brackets 5 becoming detached from the rails 7. It is a function of the push-on covers 9 to prevent this.

Such a push-on cover 9 is shown in a detailed perspective view in FIG. 6. The one-piece, injection molded, plastic push-on cover 9 comprises a flat shell 16 with an approximately rectangular base 17 and walls 18, 19 on three sides of the base 17. In FIG. 6 on one lower side of the base 17 there is no wall, instead of the wall, here a prism shaped catch 20 protrudes from the base 17.

Parallel to the base 17 a stabilizer tab element shown as tongue 21 extends from one edge of the upper wall 19 parallel to the base 17 across the shell. The tongue 21 has a longitudinal slot 22, through which the catch 20 is visible. The longitudinal slot 22 facilitates the injection molding of the catch 20 with the aid of part of the mould that can be moved through it, on which part the catch 20 and an area of the inner surface of the base 17 surrounding the catch are molded.

On both sides of the tongue 21 two fins 23 oriented perpendicular to the wall 19 and to the base 17 protrude into the interior of the shell 16 and delimit two side niches 24.

The function of the push-on cover 9 is explained in more detail using FIG. 7 to 9.

FIG. 7 shows a section of the movable rail 7 with the bridge 12 formed in its vertical side. The bridge 12 and, above and below it, remainders of the side 11 left during forming, delimit a vertically oriented slot 25, of which an upper opening between the side 11 and an upper edge 26 of the bridge is clearly visible in the figure. There is also a corresponding opening between the side and the lower edge 27 of the bridge.

FIG. 8 shows the same detail of the rail 7, wherein the tongue 13 of a bracket 5 shown as a fragment is inserted into the slot 25. Two tips 28 of a forked lower end of the tongue 13 project out from the lower opening of the slot 25. On both sides of the tongue 13, two small clips 29, which support the bracket 5 at the upper edge 26 of the bridge 12, are folded from the bracket 5 and thus determine a stop position of the bracket.

The slot 25 is much wider than the tongue 13 inserted into it, which facilitates the insertion of the tongue 13 but does not provide the tongue with a secure grip in the slot 25. In FIG. 8 one can see a free space between the bridge 12 and the tongue 13, above and below the bridge 12, along the side 11 of the rail 7. This free space is designed for the tongue 21 of the push-on cover 9 to be pushed into from above. The configuration resulting from this is shown in FIG. 9 in a section along the plane defined in FIG. 7 or FIG. 8 by dotted lines IX.

The section plane runs slightly off-centre through the cover 9, outside the longitudinal slot 22 of the tongue 21. Consequently the tongue 21, which appears to be massive in the section, completely fills the free space between the tongue 13 of the bracket 5 and the bridge 12 and holds the tongue 13 of the bracket 5 pressed against the side 11 of the rail 7, by which means the tongue 21 is frictionally engaged in the slot 25. However, the tongue 21 is protected against being accidentally pulled out by means of the catch 20, which grips under the lower edge 27 of the bridge 12 and thus prevents the cover 9 being pulled off and up. In order to remove the cover 9, the shell 16 must first be pivoted slightly around its connection to the tongue 21, so that the catch 20 under the edge 27 is freed.

In the section in FIG. 9, the fins 23, mentioned in relation to FIG. 6, are left out so as to be able to also show in the section one of the clips 29 of the bracket 5, which clips engage into the niches 24 of the push-on cover and thus fix the push-on cover 9 in the lengthwise direction of the bracket 5 and the rail 7. When the cover 9 is in place, the clips 29 not only support the bracket 5 on the bridge 12, but they also prevent accidental lifting of the bracket 5, in that, if said bracket is lifted, they hit against the upper wall 19 of the shell 16 and are held back by the wall. The shell 16 cannot respond to the upward force exerted on it by the clips as it is held back by the catch 20.

The invention claimed is:

1. A telescopic extension assembly comprising:

a.) a pair of telescopic extensions that support a goods carrier, the telescopic extensions being movable an extended disposition in which the telescopic extensions are extended relative to a reference location and a retracted disposition in which the telescopic extensions have been retracted toward the reference location and the telescopic extensions being movable relative to one another during the movement between their extended disposition and their retracted disposition;

b.) a first slot bridge mounted on a side of a respective one of the telescopic extensions, the first slot bridge having an outward portion that extends in a width direction perpendicular to the direction of extension and retraction movement to a greater extent than an adjacent portion of the respective one telescopic extension such that there is a first gap between the outward portion of the first slot bridge and the adjacent portion of the respective one telescopic extension, the first slot bridge being operable to receive a first carrier tab element of the goods carrier that has been inserted into the first gap with the width of the first carrier tab element of the goods carrier being less than the width of the first gap such that a free space remains in the first gap following insertion thereinto of the first carrier tab element of the goods carrier; and c.) a first stabilizer tab element received in the remaining free space of the first gap.

2. The telescopic extension assembly according to claim 1 and further comprising a second slot bridge mounted on a side of another respective one of the telescopic extensions, the second slot bridge having an outward portion that extends in a width direction perpendicular to the direction of extension and retraction movement to a greater extent than an adjacent portion of the respective another telescopic extension such that there is a second gap between the outward portion of the second slot bridge and the adjacent portion of the respective another telescopic extension, the second slot bridge being operable to receive a second carrier tab element of the goods carrier that has been inserted into the second gap with the width of the second carrier tab element of the goods carrier being less than the width of the second gap such that a free space remains in the second gap following insertion thereinto of the second carrier tab element of the goods carrier, and a second stabilizer tab element received in the remaining free space of the second gap, the second stabilizer tab element being held in the second gap via frictional engagement.

3. The telescopic extension assembly according to claim 2 and further comprising a push-on cover having a shell that covers the second slot bridge and the second stabilizer tab element, wherein the push-on cover is one of connected to and integrally formed with the second stabilizer element.

4. The telescopic extension assembly according to claim 3 and further comprising a catch formed on an inner side of the shell, the catch operating to engage the second slot bridge to thereby resist extraction of the second stabilizer tab element from the second gap.

5. The telescopic extension assembly according to claim 4, wherein the push-on cover is resilient and pliant such that the catch can be selectively releasably disengaged from its engagement with the second slot bridge.

6. The telescopic extension assembly according to claim 4, wherein the catch is positioned opposite a recess formed on the second stabilizer tab element.

7. The telescopic extension assembly according to claim 4, wherein an inner surface of the shell of the push-on cover is operable to be engaged by at least one projection of the goods carrier.

8. The telescopic extension assembly according to claim 7, wherein the inner surface of the shell of the push-on cover is operable to be engaged by two projections of the goods carrier arranged on both sides of the second stabilizer tab element.

* * * * *